US010697047B2

(12) United States Patent
Miyata et al.

(10) Patent No.: US 10,697,047 B2
(45) Date of Patent: Jun. 30, 2020

(54) HIGH STRENGTH ALUMINUM ALLOY EXTRUDED MATERIAL EXCELLENT IN STRESS CORROSION CRACKING RESISTANCE

(75) Inventors: Yukimasa Miyata, Shimonoseki (JP); Shinji Yoshihara, Shimonoseki (JP)

(73) Assignee: KOBE STEEL, LTD., Kobe-shi (JP)

( * ) Notice: Subject to any disclaimer, the term of this patent is extended or adjusted under 35 U.S.C. 154(b) by 107 days.

(21) Appl. No.: 13/323,056

(22) Filed: Dec. 12, 2011

(65) Prior Publication Data

US 2013/0146183 A1 Jun. 13, 2013

(51) Int. Cl.
*C22C 21/10* (2006.01)

(52) U.S. Cl.
CPC ..... *C22C 21/10* (2013.01)

(58) Field of Classification Search
CPC ..... C22C 21/10; C22F 1/053
See application file for complete search history.

(56) References Cited

U.S. PATENT DOCUMENTS

| | | | | |
|---|---|---|---|---|
| 6,231,995 | B1 | 5/2001 | Yamashita et al. | |
| 6,342,111 | B1 | 1/2002 | Meki et al. | |
| 2001/0024734 | A1 | 9/2001 | Yamashita et al. | |
| 2007/0074791 | A1* | 4/2007 | Yoshida | C22C 21/10 148/439 |
| 2009/0053098 | A1 | 2/2009 | Yoshida et al. | |
| 2011/0017366 | A1 | 1/2011 | Yoshida et al. | |

FOREIGN PATENT DOCUMENTS

| | | | | |
|---|---|---|---|---|
| JP | 1-275733 | A | | 11/1989 |
| JP | 2-47235 | A | | 2/1990 |
| JP | 3-122248 | A | | 5/1991 |
| JP | 03122248 | A | * | 5/1991 |
| JP | 5-247575 | A | | 9/1993 |
| JP | 5-311309 | A | | 11/1993 |
| JP | 6-212338 | A | | 8/1994 |
| JP | 7-164880 | A | | 6/1995 |

(Continued)

OTHER PUBLICATIONS

Antolovich, A. Practical Aspects of Converting Ingot to Billet, Metalworking:Bulk Forming, vol. 14A, ASM Handbook, ASM International, 2005, p. 227-237. (Year: 2005).*

*Primary Examiner* — George Wyszomierski
*Assistant Examiner* — Janelle Morillo
(74) *Attorney, Agent, or Firm* — Oblon, McClelland, Maier & Neustadt, L.L.P.

(57) ABSTRACT

An aluminum alloy extruded material in relation with the present invention is with high strength by die quench air cooling and excellent in SCC resistance. The aluminum alloy extruded material is an Al—Zn—Mg-based aluminum alloy extruded material for structural member for automobiles such as a bumper reinforce, a door guard bar and the like which satisfies three expressions of $5.0 \leq [Zn] \leq 7.0$, $[Zn]/5.38 < [Mg] \leq [Zn]/5.38+0.7$, and $[Zn]+4.7[Mg] \leq 14$, where [Mg] represents mass % of Mg and [Zn] represents mass % of Zn, and contains at least either one element of Cu: 0.1-0.6 mass % and Ag: 0.01-0.15 mass %, Ti: 0.005-0.05 mass %, and at least one element out of Mn: 0.1-0.3 mass %, Cr: 0.05-0.2 mass %, Zr: 0.05-0.2 mass %.

16 Claims, 2 Drawing Sheets

(56) References Cited

FOREIGN PATENT DOCUMENTS

| | | | |
|---|---|---|---|
| JP | 7-268533 | A | 10/1995 |
| JP | 8-144031 | A | 6/1996 |
| JP | 8-269651 | A | 10/1996 |
| JP | 11-264044 | | 9/1999 |
| JP | 11-314521 | A | 11/1999 |
| JP | 2000-248327 | A | 9/2000 |
| JP | 2001-26834 | A | 1/2001 |
| JP | 2001-115227 | A | 4/2001 |
| JP | 2001-140029 | A | 5/2001 |
| JP | 2002-67693 | A | 3/2002 |
| JP | 2002-327229 | | 11/2002 |
| JP | 2008-274441 | A | 11/2008 |
| JP | 2011-144396 | A | 7/2011 |
| WO | WO 2008/123184 | A1 | 10/2008 |

* cited by examiner

HIGH STRENGTH ALUMINUM ALLOY EXTRUDED MATERIAL EXCELLENT IN STRESS CORROSION CRACKING RESISTANCE

BACKGROUND OF THE INVENTION

1. Field of the Invention

The present invention relates to a high strength aluminum alloy extruded material excellent in stress corrosion cracking resistance, and relates specifically to an aluminum alloy extruded material suitably used as structural materials for automobiles such as a bumper reinforce, door guard bar, and the like.

2. Description of the Related Art

In order to reduce the weight of an automobile, Al—Zn—Mg-based high strength aluminum alloy extruded materials (refer to Japanese Unexamined Patent Application No. 2002-327229, Japanese Unexamined Patent Application No. H11-264044) are used as energy absorption members such as a bumper reinforce, door guard bar, and the like. However, the Al—Zn—Mg-based aluminum alloy extruded material has a risk of causing stress corrosion cracking (hereinafter referred to as SCC), is obligedly subjected to an overaging treatment and is used at the proof stress of approximately 300 N/mm$^2$ in order to avoid the risk, and is weakened in features as a high strength alloy.

For the purpose of further reducing the weight of an automobile, high-strengthening is required in the Al—Zn—Mg-based aluminum alloy extruded material used for the structural materials for automobiles such as a bumper reinforce and the like. However, when Zn and Mg are highly contained in order to achieve high-strengthening of the present Al—Zn—Mg-based alloy, the SCC resistance deteriorates because $MgZn_2$ of intergranular precipitates is distributed in a high density, and the alloy cannot be applied as the structural materials for automobiles. Also, the extrusion performance deteriorates, thinly formation becomes hard, and, as a result, the weight reducing effect cannot be exerted.

SUMMARY OF THE INVENTION

The present invention has been developed in view of such problems of the prior arts, and its object is to provide an Al—Zn—Mg-based aluminum alloy extruded material with high strength, excellent in SCC resistance, and excellent in extrusion performance.

An Al—Zn—Mg-based aluminum alloy is an alloy achieving the high strength by distributing $MgZn_2$ which is a precipitate formed of Zn and Mg in a high density. The present invention utilizes the fact that Mg added in excess than an Mg amount which adequately formed $MgZn_2$ (the stoichiometric ratio of $MgZn_2$) contributes to high strengthening. By suppressing the Zn amount to a small amount, even when the $MgZn_2$ amount is reduced than that in prior arts, by adding Mg in excess than an amount corresponding to the stoichiometric ratio of $MgZn_2$, high strengthening becomes possible. Thus, the Al—Zn—Mg-based aluminum alloy extruded material can be high-strengthened without deteriorating the SCC resistance. On the other hand, when the Mg amount in excess is too much, the extrusion performance deteriorates, the extrusion speed drops, and die quench air cooling (air-cooling the extruded material immediately after extrusion on line; also referred to as "press quenching") cannot be executed. Also, as the Mg amount in excess increases, intergranular precipitates become fine and continuous which result in deterioration of the SCC resistance. Accordingly, in the present invention, the limit amount of the Mg amount in excess that could achieve high strengthening without deteriorating the extrusion performance and the SCC resistance was determined.

An Al—Zn—Mg-based aluminum alloy extruded material in relation with the present invention satisfies inequalities (1)-(3) below:

$$5.0 \leq [Zn] \leq 7.0 \quad (1)$$

$$[Zn]/5.38 < [Mg] \leq [Zn]/5.38 + 0.7 \quad (2)$$

$$[Zn] + 4.7[Mg] \leq 14 \quad (3)$$

where, [Mg] represents mass % of Mg and [Zn] represents mass % of Zn; and contains at least either one element of Cu: 0.1-0.6 mass % and Ag: 0.01-0.15 mass %, Ti: 0.005-0.05 mass %, and at least one element out of Mn: 0.1-0.3 mass %, Cr: 0.05-0.2 mass %, Zr: 0.05-0.2 mass %, the remainder including Al and inevitable impurities.

Because the stoichiometric ratio (mass ratio) of $MgZn_2$ is 1:5.38 in terms of [Mg]:[Zn], the inequality (2) means that [Mg] is excessively higher than the amount corresponding to the stoichiometric ratio of $MgZn_2$, and [Mg] in excess is 0.7 mass % or below.

The Al—Zn—Mg-based aluminum alloy extruded material in relation with the present invention is with high strength and excellent in SCC resistance. Also, because it is excellent in extrusion performance, the high strength generally equivalent to that of a T6 material (subjected to a solution heat treatment and to an aging treatment thereafter) can be obtained by die quench air cooling, and thinly forming is possible. By applying the high strength Al—Zn—Mg-based aluminum alloy extruded material in relation with the present invention, the weight of the structural members for automobiles such as a bumper reinforce, door guard bar, and the like can be further reduced.

DESCRIPTION OF THE PREFERRED EMBODIMENTS

Figure 1:
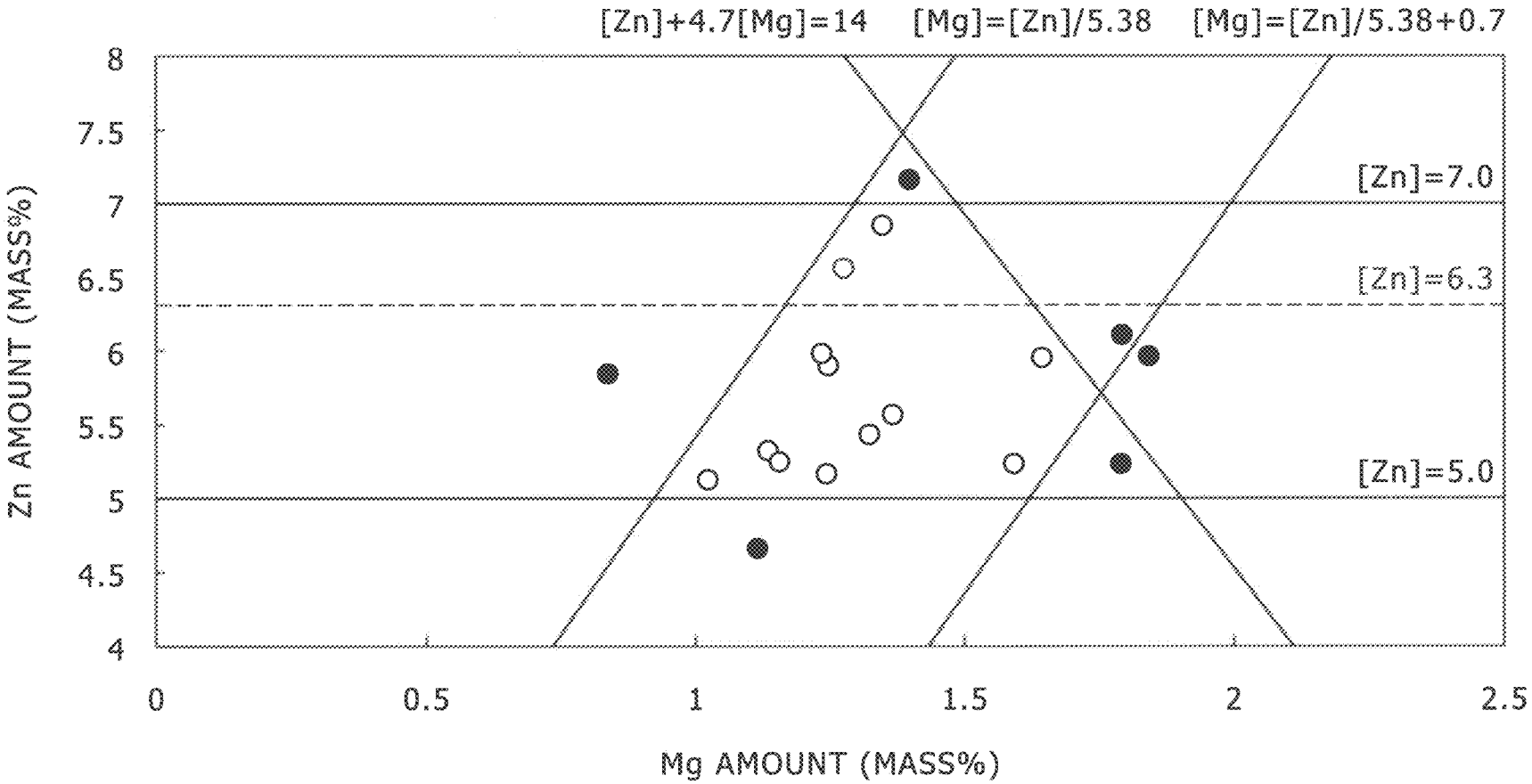
FIG. 1 is a drawing showing the scope of Zn amount and Mg amount of the Al—Zn—Mg-based alloy in relation with the present invention.
Figure 2:
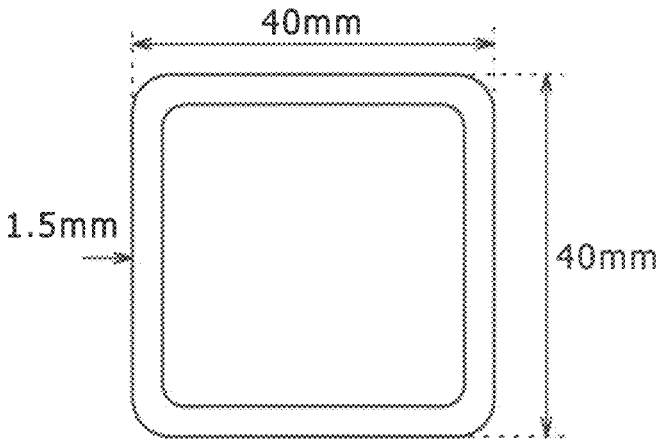
FIG. 2 is a drawing showing a cross-sectional shape of an extruded material of an example.

Below, the composition and the like of the Al—Zn—Mg-based aluminum alloy extruded material in relation with the present invention will be discussed in detail.

Zn;

When Zn content is below 5.0 mass %, the strength is not sufficient, and when Zn content exceeds 7.0 mass %, the intergranular precipitates $MgZn_2$ increase and the SCC sensitivity becomes sharp. Therefore, Zn content is to be 5.0-7.0 mass %. When importance is attached to the SCC resistance in particular, the range of comparatively lower Zn content, that is 5.0-6.3 mass % specifically, is preferable, more preferably below 6.0 mass %, and further more preferably 5.8 mass % or below. On the other hand, when Zn content exceeds 6.3 mass %, it is preferable to add both Cu and Ag described below in order to suppress the SCC sensitivity from becoming sharp.

Mg;

Mg forms $MgZn_2$ with Zn, and improves the strength of the Al—Zn—Mg-based alloy. Its content is limited as per the expressions (2) and (3) related with Zn content.

When Mg content is in the range below the lower limit value of the expression (2) (the range Zn is equal to or in excess of the amount corresponding to the stoichiometric ratio of $MgZn_2$), the $MgZn_2$ amount reduces and the strength is not sufficient. When Mg content becomes in the range of the lower limit value of the expression (2) or above (the range Mg is in excess of the amount corresponding to the stoichiometric ratio of $MgZn_2$), Mg in excess contributes to high strengthening, and therefore high strengthening becomes possible while suppressing the $MgZn_2$ amount. However, when the Mg amount in excess exceeds 0.7 mass %, the extrusion performance deteriorates, and the high strength (compared with a T6 material) cannot be secured by die quench air cooling. Also, the productivity drops and thinly formation becomes hard. The Mg amount in excess is preferable to be 0.6 mass % or below.

Further, when Zn content and Mg content exceed the stipulation of the expression (3), the intergranular precipitates are formed finely and continuously, and the SCC resistance deteriorates.

FIG. 1 illustrates the scope of Zn and Mg amount of the Al—Zn—Mg-based alloy in relation with the present invention. The points ○ in the drawing represent Nos. 1-12 of the examples described below, and the points ● in the drawing represent Nos. 13-18 of the references described below. The range of a pentagon surrounded by straight lines representing [Zn]=5.0, [Zn]=7.0, [Mg]=[Zn]/5.38, [Mg]=[Zn]/5.38+0.7, and [Zn]+4.7[Mg]=14 is the stipulated scope of the present invention. However, as described above, from the viewpoint of attaching importance to the SCC resistance, the low Zn range of [Zn]6.3 is preferable, and in the high Zn range of [Zn]>6.3, it is preferable to add both Cu and Ag and to improve the SCC resistance.

Cu, Ag;

Cu and Ag have an action of improving the SCC resistance of the Al—Zn—Mg-based alloy, and either one or both are to be added.

When Cu content is below 0.1 mass % and Ag content is below 0.01 mass %, the SCC resistance improving effect is small. On the other hand, when Cu content exceeds 0.6 mass %, the extrusion performance and the weldability are deteriorated. Also, because the quenching sensitivity becomes sharp, quenching cannot be executed by air cooling. Even if Ag is added to exceed 0.15 mass %, the effect saturates. Therefore, Cu content is to be 0.1-0.6 mass %, and Ag content is to be 0.01-0.15 mass %.

When Zn content is below 6.3 mass %, addition of either one element of Cu or Ag may be possible, however when Zn content exceeds 6.3 mass %, it is preferable to add both Cu and Ag in order to suppress deterioration of the SCC resistance.

Ti;

Ti has effects of forming $Al_3Ti$ in molten metal and refining crystal grains of an ingot. When Ti content is below 0.005 mass %, the crystal grain refining effect is small. On the other hand, when Ti content exceeds 0.05 mass %, coarse crystallized substances are formed in the ingot, and the elongation is lowered. Therefore, Ti content is to be 0.005-0.05 mass %.

Mn, Cr, Zr;

Mn, Cr and Zr have effects of precipitating as fine dispersed particles in aluminum by a homogenizing treatment and suppressing recrystallization and can improve the SCC resistance by suppressing recrystallization, and therefore either one element or two elements or more are to be added. When all of Mn, Cr and Zr are below 0.1 mass %, below 0.05 mass % and below 0.05 mass % respectively, surface recrystallization is generated thick during extrusion, and the SCC resistance deteriorates. On the other hand, when Mn, Cr and Zr exceed 0.3 mass %, 0.2 mass % and 0.2 mass % respectively, the quenching sensitivity becomes sharp, coarse crystallized substances are formed, and therefore the elongation lowers. Accordingly, the contents of Mn, Cr and Zr are to be 0.1-0.3 mass %, 0.05-0.2 mass % and 0.05-0.2 mass % respectively. Also, because the action of Zr to sharpen the quenching sensitivity is comparatively small, it is preferable to add Zr solely or Zr plus either one element or both of Mn and Cr.

Method for Manufacturing;

The Al—Zn—Mg-based aluminum alloy extruded material in relation with the present invention can be manufactured by casting a billet by melting, executing a homogenizing treatment, extrusion thereafter, air cooling die quenching of the extruded material immediately after extrusion, and thereafter executing an aging treatment. Also, in order to execute quenching by air cooling die quenching, the extrusion speed should be sufficiently high (should be excellent in the extrusion performance). For quenching, rapid cooling from a high temperature state (450° C. or above, for example) is necessary, however, when the extrusion speed is slow, the temperature of the extruded material drops before being air-cooled on line, and sufficient quenching cannot be executed. Therefore, even when the aging treatment is executed, high strength cannot be obtained, and the strength becomes largely inferior compared with the T6 material.

On the other hand, for the Al—Zn—Mg-based aluminum alloy extruded material in relation with the present invention, a solution heat treatment and an aging treatment (T6 material) can also be executed instead of die quenching. In both cases, each process of working and heat treatment can be executed under normal conditions. Also the aging treatment condition may be selected from the scope of 65-95° C. for 2-6 hours, and 125-165° C. for 7-13 hours (including an overaging region).

EXAMPLES

The Al—Zn—Mg-based alloys having chemical compositions shown in Table 1 were molten by an ordinary method, and billets with 155 mm diameter were respectively casted. After the billets were subjected to a homogenizing treatment at 470° C.×6 h, thereafter air-cooled by fans, heated again to 450° C., and were porthole-extruded into a hollow cross-sectional shape shown in FIG. 1. The thickness of the cross section of the extruded material was 1.5 mm. Die quenching was executed by air cooling by fans from a high temperature state (450° C. or above) in extruding, and the average cooling rate to 200° C. was approximately 160° C./min.

Next, two pieces each of short materials were taken by cutting from respective extruded materials, a two-stage aging treatment was executed with 90° C.×3 h and 140° C.×8 h for one short material, and a sample (T5 material) was obtained. Also, for the purpose of evaluating the extrusion performance, the other short material was subjected to a solution heat treatment (heated at 450° C.×1 h, and thereafter water-cooled), thereafter a two-stage aging treatment was executed with 90° C.×3 h and 140° C.×8 h, and the T6 material that became a reference for evaluating the extrusion performance was obtained.

TABLE 1

| Chemical composition (mass %) | | | | | | | | | | |
|---|---|---|---|---|---|---|---|---|---|---|
| No. | Zn | Mg | Cu | Ag | Mn | Cr | Zr | Ti | Mg in excess | Zn + 4.7Mg |
| 1 | 5.16 | 1.25 | 0.25 | Tr. | Tr. | Tr. | 0.13 | 0.02 | 0.29 | 11.04 |
| 2 | 5.90 | 1.25 | 0.24 | Tr. | Tr. | Tr. | 0.14 | 0.02 | 0.15 | 11.77 |
| 3 | 6.85 | 1.35 | 0.23 | 0.11 | Tr. | Tr. | 0.13 | 0.02 | 0.08 | 13.20 |
| 4 | 5.13 | 1.03 | 0.25 | Tr. | Tr. | Tr. | 0.15 | 0.02 | 0.08 | 9.97 |
| 5 | 5.23 | 1.60 | 0.24 | Tr. | Tr. | Tr. | 0.06 | 0.02 | 0.63 | 12.75 |
| 6 | 5.95 | 1.65 | 0.21 | Tr. | Tr. | Tr. | 0.15 | 0.03 | 0.54 | 13.71 |
| 7 | 5.56 | 1.37 | 0.23 | Tr. | Tr. | Tr. | 0.16 | 0.02 | 0.34 | 12.00 |
| 8 | 5.43 | 1.33 | 0.20 | 0.024 | Tr. | Tr. | 0.15 | 0.02 | 0.32 | 11.68 |
| 9 | 5.98 | 1.24 | 0.51 | Tr. | Tr. | Tr. | 0.15 | 0.02 | 0.13 | 11.81 |
| 10 | 6.56 | 1.28 | 0.22 | Tr. | Tr. | Tr. | 0.15 | 0.02 | 0.06 | 12.58 |
| 11 | 5.32 | 1.14 | Tr. | 0.06 | Tr. | Tr. | 0.14 | 0.02 | 0.15 | 10.68 |
| 12 | 5.24 | 1.16 | 0.25 | Tr. | 0.15 | 0.10 | 0.15 | 0.02 | 0.19 | 10.69 |
| 13 | 4.66* | 1.12 | 0.26 | Tr. | Tr. | Tr. | 0.11 | 0.02 | 0.25 | 9.92 |
| 14 | 7.15* | 1.40 | 0.23 | 0.10 | Tr. | Tr. | 0.14 | 0.03 | 0.07 | 13.73 |
| 15 | 5.84 | 0.84 | 0.24 | Tr. | Tr. | Tr. | 0.14 | 0.02 | −0.25* | 9.79 |
| 16 | 5.96 | 1.85 | 0.25 | Tr. | Tr. | Tr. | 0.15 | 0.02 | 0.74* | 14.66* |
| 17 | 5.23 | 1.80 | 0.25 | Tr. | Tr. | Tr. | 0.16 | 0.03 | 0.83* | 13.69 |
| 18 | 6.11 | 1.80 | 0.28 | Tr. | Tr. | Tr. | 0.15 | 0.02 | 0.66 | 14.57* |
| 19 | 5.86 | 1.25 | 0.05* | Tr.* | Tr. | Tr. | 0.14 | 0.02 | 0.16 | 11.74 |
| 20 | 5.67 | 1.23 | 0.83* | 0.13 | Tr. | Tr. | 0.15 | 0.03 | 0.18 | 11.45 |
| 21 | 5.65 | 1.24 | 0.26 | Tr. | Tr.* | Tr.* | Tr.* | 0.02 | 0.19 | 11.48 |
| 22 | 5.62 | 1.21 | 0.21 | Tr. | Tr. | Tr. | 0.32* | 0.02 | 0.17 | 11.31 |

*Out of stipulated range.

The tests described below were executed using the samples and the T6 materials. The results are shown in Table 2.

Tensile Test;

JIS No. 13B specimens were taken from the samples (T5 materials) and T6 materials, and the tensile strength, proof stress, and elongation were measured according to the tensile testing method of JIS Z 2241. The mechanical properties shown in Table 2 are those of the samples (T5 materials). The sample (T5 material) having the tensile strength and the proof stress of 90% or above of those of the T6 material was evaluated to be good in the extrusion performance, 80% or above and below 90% was evaluated to be satisfactory in the extrusion performance, below 80% was evaluated to be poor in the extrusion performance, and the sample having the proof stress of 380 N/mm$^2$ or above and having satisfactory or better extrusion performance was determined to have passed. Also, with respect to the elongation, the sample with 12% or above elongation was determined to have passed.

SCC Test;

The stress corrosion cracking resistance test by a chromic acid promotion method was executed. A plate-like specimen was taken from each sample in parallel with the extruding direction avoiding the welding part, was immersed for up to 10 hours at maximum in the test solution of 90° C. under a state that the tensile stress equivalent to 95% of the proof stress was applied in the extruding direction according to JIS H 8711, and the SCC was visually observed. Also, a stress was applied by tightening the bolt and nut of the jig, the tensile stress was generated on the outer surface of the specimen, and the stress value was measured by a strain gauge adhered to the outer surface of the specimen. Further, the test solution was prepared by adding 36 g of chromium oxide, 30 g of potassium dichromate, and 3 g of sodium chloride to the distilled water (per 1 liter). Whether the SCC occurred or not was observed at every 0.5 hours, one the SCC did not occur during 10 hours was evaluated to be good, one the SCC occurred in 6 hours or above and below 10 hours was evaluated to be satisfactory, one the SCC occurred within 6 hours was evaluated to be poor, and one better than satisfactory was determined to have passed.

Figure 3:
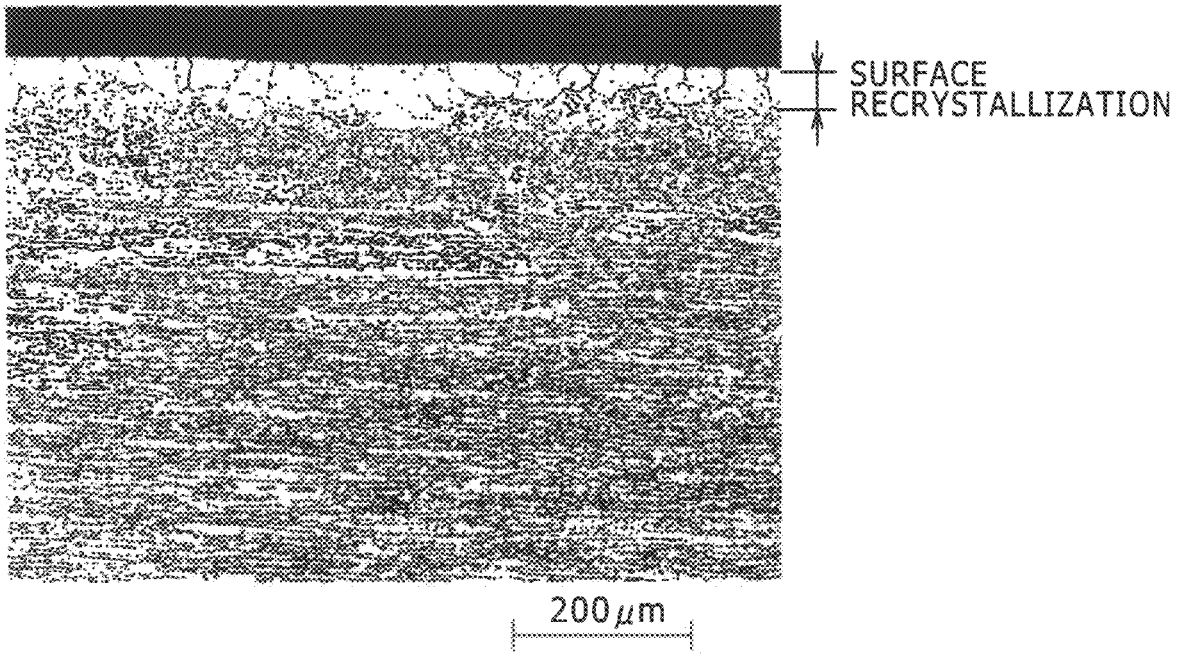
FIG. 3 is a microscopic photograph of a cross-sectional structure of the extruded material of the example.

Microstructure;

With respect to the samples evaluated to be satisfactory or poor in the SCC test, a specimen of 20 mm length was taken in parallel with the extruding direction, the cross section parallel with the extrusion direction of non welded part was etched by a Keller solution, and thereafter the microstructure of the outer surface (a portion equivalent to the outer surface of the hollow material) was observed. The sample with 20 μm or above thickness of the surface recrystallization layer was determined to have been deteriorated in the SCC resistance because the surface recrystallization layer was thick, and "poor" was marked in the column of the microstructure of Table 2. The sample with below 20 μm thickness of the surface recrystallization layer was determined not to have any problem on the microstructure itself, and "good" was marked in the column of the microstructure in Table 2. Also, FIG. 3 is the microstructure (microscopic photograph) of the sample of No. 21, the thickness of the surface recrystallization layer is shown by a two-headed arrow, and coarsened surface recrystallized particles are observed.

TABLE 2

| Respective characteristics | | | | | | |
|---|---|---|---|---|---|---|
| | Mechanical properties | | | | | |
| No. | Tensile strength N/mm$^2$ | Proof stress N/mm$^2$ | Elongation % | Microstructure | Extrusion performance | SCC resistance |
| 1 | 451 | 403 | 14.2 | — | Good | Good |
| 2 | 482 | 429 | 13.5 | — | Good | Good |
| 3 | 505 | 446 | 13.8 | — | Good | Good |
| 4 | 435 | 389 | 13.6 | — | Good | Good |
| 5 | 463 | 413 | 13.9 | — | Satisfactory | Good |
| 6 | 479 | 432 | 14.0 | — | Good | Good |
| 7 | 481 | 430 | 14.3 | — | Good | Good |
| 8 | 480 | 423 | 13.8 | — | Good | Good |
| 9 | 495 | 434 | 14.0 | — | Good | Good |
| 10 | 502 | 454 | 14.3 | Good | Good | Satisfactory |
| 11 | 441 | 396 | 14.3 | — | Good | Good |
| 12 | 433 | 390 | 14.2 | — | Good | Good |
| 13 | 415 | 362* | 14.1 | — | Good | Good |
| 14 | 505 | 451 | 14.7 | Good | Good | Poor* |
| 15 | 399 | 353* | 12.9 | — | Good | Good |
| 16 | 476 | 427 | 14.0 | Good | Poor* | Poor* |
| 17 | 453 | 407 | 13.9 | — | Poor* | Good |
| 18 | 489 | 438 | 13.5 | Good | Satisfactory | Poor* |
| 19 | 473 | 418 | 14.3 | Good | Good | Poor* |
| 20 | 383 | 342* | 13.2 | — | Poor* | Good |
| 21 | 465 | 407 | 13.7 | Poor | Good | Poor* |
| 22 | 459 | 414 | 8.2* | — | Good | Good |

*Out of stipulated range/out of criteria.

As shown in Table 2, Nos. 1-12 having the composition within the stipulated scope of the present invention are large in the proof stress and elongation, and are excellent in both of the extrusion performance and the SCC resistance. Also, in No. 3, although Zn amount exceeds 6.3 mass %, because both Cu and Ag were added, the SCC resistance is excellent. In No. 10, because Zn amount exceeds 6.3 mass % and Ag was not added, the SCC resistance is slightly inferior compared with other examples. In No. 11, although Cu was not added (0.01 mass % or below), because Ag was added, the SCC resistance is excellent.

On the contrary, in No. 13, because Zn amount is below the lower limit, $MgZn_2$ amount is small and the strength is low. In No. 14, because Zn amount exceeds 7.0 mass %, although both Cu and Ag were added, the SCC resistance is low. Because No. 15 is on the excessive Zn side (Mg content is equal to or below the lower limit of the expression (2)), $MgZn_2$ amount is small and the strength is low. In No. 16, because the Mg amount in excess is too much (Mg content exceeds the upper limit of the inequality (2)), the extrusion performance is low, and, because Zn+4.7 Mg exceeds the upper limit of the inequality (3), the SCC resistance is low. In No. 17, because the Mg amount in excess is too much (Mg content exceeds the upper limit of the expression (2)), the extrusion performance is low. In No. 18, because Zn+4.7 Mg exceeds the upper limit of the expression (3), the SCC resistance is low.

In No. 19, because Cu amount and Ag amount are below the lower limit, the SCC resistance is low. In No. 20, because Cu amount exceeds the upper limit, the extrusion performance is low, the quenching sensitivity is sharp, quenching cannot be executed by air-cooling, and the strength is low. In No. 21, because all of Mn, Cr and Zr are below the lower limit, the surface recrystallized particles are coarsened (refer to FIG. 3), and the SCC resistance is low. In No. 19, because Zr exceeds the upper limit, the coarse crystallized substances are formed, and the elongation is low.

What is claimed is:

1. An aluminum alloy extruded material, comprising:

aluminum, zinc, magnesium, titanium, copper, at least one of manganese, zirconium, and chromium, and optionally silver, wherein the aluminum alloy comprises zinc and magnesium in such amounts that the aluminum alloy satisfies expressions (1), (2), and (3):

$$5.0 \leq [Zn] \leq 5.9 \quad (1)$$

$$[Zn]/5.38 < [Mg] \leq [Zn]/5.38 + 0.7 \quad (2)$$

$$[Zn] + 4.7[Mg] \leq 14 \quad (3),$$

where [Mg] represents mass % of Mg and [Zn] represents mass % of Zn, wherein titanium is present in an amount of 0.005 to 0.05 mass %, wherein copper is present in an amount of 0.1 to 0.6 mass %, and wherein when present, silver is present in an amount of 0.01 to 0.15 mass %, when present, manganese is present in an amount of 0.1 to 0.3 mass %, when present, zirconium is present in an amount of 0.05 to 0.2 mass %, and when present, chromium is present in an amount of 0.05 to 0.2 mass %.

2. The aluminum alloy extruded material according to claim 1, which exhibits a proof stress of at least 380 N/mm$^2$.

3. The aluminum alloy extruded material according to claim 1, which exhibits an elongation percentage of at least 12%.

4. The aluminum alloy extruded material according to claim 1, wherein silver is present.

5. A bumper reinforcement material, comprising the aluminum alloy extruded material according to claim 1.

6. The aluminum alloy extruded material according to claim 1, which satisfies:

$$5.56 \leq [Zn] \leq 5.90.$$

7. The aluminum alloy extruded material according to claim 1, which satisfies:

$$[Zn]/5.38+0.06 \leq [Mg] \leq [Zn]/5.38+0.54.$$

8. The aluminum alloy extruded material according to claim 1, which does not exhibit stress cracking corrosion determined according to JIS H 8711 for at least 6 hours.

9. The aluminum alloy extruded material according to claim 1, which is obtained by a process comprising homogenizing an aluminum alloy billet for six hours at a temperature of 470° C.

10. The aluminum alloy extruded material according to claim 1, wherein zirconium is present.

11. The aluminum alloy extruded material according to claim 10, which does not exhibit stress cracking corrosion determined according to JIS H 8711 for at least 6 hours.

12. The aluminum alloy extruded material according to claim 10, which is obtained by a process comprising homogenizing an aluminum alloy billet for six hours at a temperature of 470° C.

13. The aluminum alloy extruded material according to claim 1, wherein manganese is present.

14. The aluminum alloy extruded material according to claim 1, wherein chromium is present.

15. The aluminum alloy extruded material according to claim 1, having a surface recrystallization layer, wherein a thickness of the surface recrystallization layer is less than 20 μm.

16. The aluminum alloy extruded material according to claim 1, which exhibits a tensile strength and a proof stress of at least 80% of those of a T6 material.

* * * * *